United States Patent [19]

Aoki

[11] Patent Number: 4,527,287

[45] Date of Patent: Jul. 9, 1985

[54] BASEBALL GLOVE OR MITT

[75] Inventor: Akio Aoki, Osaka, Japan

[73] Assignee: Figgie International Inc., Willoughby, Ohio

[21] Appl. No.: 507,518

[22] Filed: Jun. 24, 1983

[51] Int. Cl.[3] ..... A41D 13/10

[52] U.S. Cl. ..... 2/19; 2/161 A

[58] Field of Search ..... 2/19, 16, 18, 158, 159, 2/160, 161 R, 161 A

[56] References Cited

U.S. PATENT DOCUMENTS

| | | | |
|---|---|---|---|
| 1,045,231 | 11/1912 | Whitley | 2/19 |
| 2,636,172 | 4/1953 | Stobbe | 2/19 |
| 2,995,756 | 8/1961 | Latina | 2/19 |
| 3,030,629 | 4/1962 | Spohr | 2/19 |
| 3,169,250 | 2/1965 | Heiman | 2/19 |
| 3,321,771 | 5/1967 | Latina | 2/19 |
| 3,576,036 | 8/1969 | Latina | 2/19 |
| 3,588,915 | 6/1971 | Latina | 2/19 |
| 3,588,917 | 6/1971 | Antonious | 2/161 A |
| 3,590,389 | 7/1971 | Latina | 2/19 |
| 3,602,915 | 9/1971 | Collins | 2/19 |
| 3,623,163 | 11/1971 | Latina | 2/19 |
| 3,997,922 | 12/1976 | Huhta | 1/161 A |
| 4,104,740 | 8/1978 | Rinehart | 2/158 |

*Primary Examiner*—Werner H. Schroeder
*Assistant Examiner*—J. L. Kravitz
*Attorney, Agent, or Firm*—Senniger, Powers, Leavitt and Roedel

[57] ABSTRACT

A baseball glove or mitt having an outer shell comprising front and a back plies joined together to form thumb and finger stalls and a hand-receiving pocket. A hand-receiving opening at the bottom of the glove provides entry into the shell. The back ply of the shell in the area between the stalls and the hand-receiving opening is formed for substantially covering the back of the hand of a person wearing the glove, a portion of the back ply in said area having a zone with a flexibility greater than the remainder of said portion for enabling the glove readily to flex when the hand is flexed to close the glove.

20 Claims, 7 Drawing Figures

BASEBALL GLOVE OR MITT

BACKGROUND OF THE INVENTION

This invention relates generally to a baseball glove or mitt, and more particularly to a glove construction which provides greater glove flexibility for enabling the glove to be more readily closed.

Reference may be made to U.S. Pat. Nos. 3,321,771, 3,576,036 and 3,602,915 for a description of glove constructions generally relevant to this invention.

SUMMARY OF THE INVENTION

Among the several objects of the present invention may be noted the provision of an improved baseball glove (or mitt) construction which provides increased flexibility at the back of the glove for enabling the glove to be more readily closed; the provision of such a glove which has a reduced break-in time; the provision of such a glove which is durable; and the provision of such a glove which is pleasing in appearance.

Generally, a baseball glove or mitt of the present invention has an outer shell comprising front and a back plies joined together to form thumb and finger stalls and a hand-receiving pocket. A hand-receiving opening at the bottom of the glove provides entry into the shell. The back ply of the shell in the area between the stalls and the hand-receiving opening is formed for substantially covering the back of the hand of a person wearing the glove, a portion of the back ply in said area having a zone with a flexibility greater than the remainder of said portion for enabling the glove readily to flex when the hand is flexed to close the glove.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
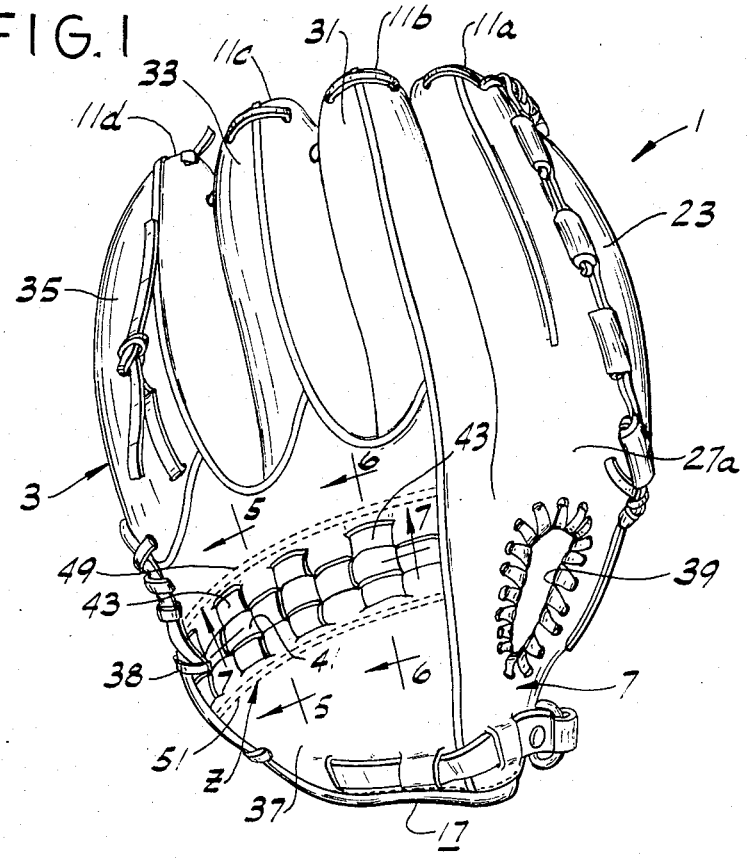
FIG. 1 is a view of the back of a glove of the present invention.

Referring now to the drawings, a baseball glove of the present invention is indicated in its entirety by the reference numberal 1. As is conventional, the glove is made of leather, although it may be made of another suitable flexible sheet material. The outer shell of the glove, generally designated 3, comprises a front or palm ply 5 forming the front face of the glove, and a back ply generally indicated at 7 forming the back face of the glove. In the glove shown, which is a fielder's glove, the palm and back plies 5, 7 are joined together to form a thumb stall 9 which at least partially receives the thumb of a player wearing the glove, and four separate finger stalls designated 11*a*–11*d* into which a player's fingers may at least partially be inserted, one finger in each finger stall. The thumb and finger stalls 9, 11*a*–11*d* are separated by four intervening crotches 13*a*–13*d*.

While a fielder's glove is shown and described herein for purposes of illustration, it will be understood that in certain glove or mitt designs of this invention, less than four separate finger stalls (e.g., a single stall for all four fingers) may be provided. The glove also has a hand-receiving pocket 15 inside the shell 3, and a hand-receiving opening 17 at the bottom of the glove providing access to the pocket 15 and to the thumb and finger stalls. A lining for the glove is indicated at 19.

Figure 2:
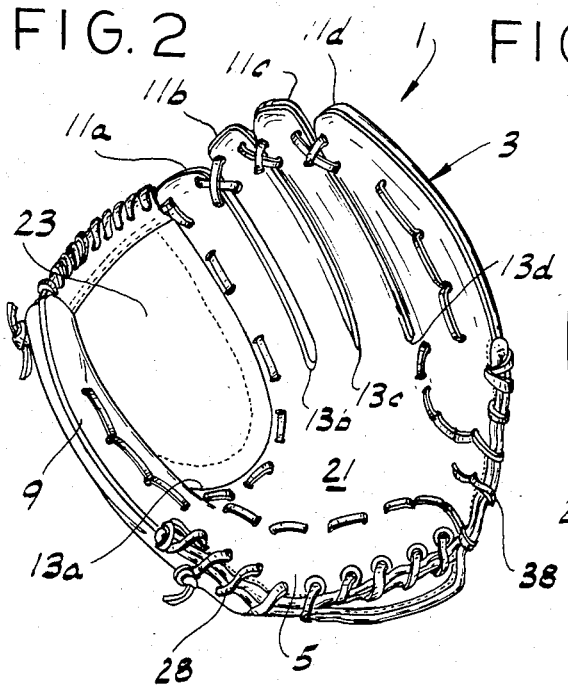
FIG. 2 is a view of the front of the glove.

As shown in FIG. 2, a portion of the palm ply 5 of the glove is concave to form a ball-receiving pocket 21. A web or backstop, generally designated 23, is also provided between the thumb stall 9 and the adjacent (index) finger stall 11*a* above crotch 13*a*. This web 23 may be of conventional design and is suitably secured (e.g., laced) to the glove.

Figure 3:
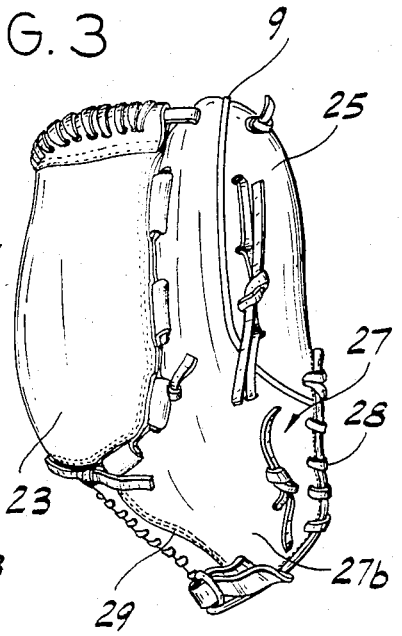
FIG. 3 is a right side elevation of FIG. 1.
Figure 4:
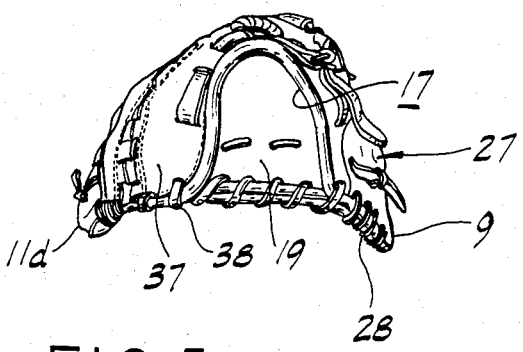
FIG. 4 is a view of the bottom of the glove.

In the embodiment shown, the palm ply 5 is constituted by a single piece of material (e.g., leather) while the back ply 7 comprises a plurality of separate pieces seamed together. Specifically, the back ply includes a thumb piece 25 extending longitudinally of the glove at the thumb side of the glove (the right side as viewed in FIG. 3) from the top of the glove to a point about halfway down the glove, forming a part of thumb stall 9. The thumb piece 25 is seamed along one side (its right side as viewed in FIG. 3) to the palm ply 5 of the glove. The back ply also includes a first bifurcated strip or fourchette generally indicated at 27 which is seamed to the thumb piece 25 and which extends longitudinally of the glove from the top to the bottom of the glove to form a part of the thumb stall 9, part of the first (index) finger stall 11*a*, and a part of the second finger stall 11*b*. This fourchette is of two-piece construction comprising left and right pieces designated 27*a* and 27*b*, respectively, in FIGS. 1 and 3, the two pieces being stitched together along a line of stitching indicated at 29 in FIG. 3. The lower right side of fourchette 27 below thumb piece 25 is secured to the palm ply 5 by lacing 28.

The back ply 7 further comprises a second fourchette, designated 31, seamed to the left piece 27*a* of the first fourchette 27. The second fourchette 31 extends longitudinally of the glove from the top of the glove down to a point below the crotch 13*c* between the second and third finger stalls 11*b* and 11*c*, respectively, to form part of the second finger stall and part of the third finger stall. Indicated at 33 is a third fourchette seamed to the second fourchette 31 and extending longitudinally of the glove from the top of the glove down to a point below the crotch 13*d* between the third and fourth finger stalls 11*c* and 11*d*, respectively. The third fourchette 33 forms part of the third finger stall and part of the fourth finger stall.

The back ply 7 also includes a little-finger piece, designated 35, seamed along one side (its right side as viewed in FIG. 1) to the third fourchette 33 and along its other (left) side to the palm ply 5. This little-finger piece extends longitudinally of the little-finger stall 11*d* to form part of that stall. The back ply 7 is completed by a back panel piece 37 which is seamed along its top to the little finger piece 35 and to the second and third fourchettes 31 and 33, respectively, and which is seamed along one side (its right side as viewed in FIG. 1) to the left piece 27*a* of the first fourchette. The opposite (left) side of the back panel piece 37 is secured to the palm ply 5 by lacing 38.

It will be observed that the back ply 7 of the glove in the area between the finger stalls 11*a*–11*d* and the hand-receiving opening 17 is formed for substantially covering the back of the hand of a player wearing the glove. Thus, unlike a glove which is constructed with a wrist strap having a large opening thereabove exposing the back of the hand, the glove of the present invention has a substantially closed back, the only opening being a single-finger opening 39 in the left piece 27*a* of the first fourchette 27. This opening is sized to receive only one finger and is located in alignment with a player's index finger so that the index finger may be inserted through the opening and placed on the outside of the back ply of the glove. For a more detailed description of this particular feature of the glove, reference may be made to U.S. Pat. No. 3,602,915.

In accordance with this invention, the back panel piece 37 (which constitutes a portion of the back ply in the substantially closed area referred to above) has a section or zone Z with a flexibility greater than the remainder of the back panel piece for enabling the glove readily to flex when the hand is flexed to close the glove. This zone is generally rectangular in shape and extends generally transversely with respect to the back ply 7 of the glove from a point adjacent the little-finger side of the glove to a point adjacent the single-finger opening 39. The zone is located approximately midway between the hand-receiving opening 17 and the inner (lower) ends of the second, third and fourth finger stalls 11*b*–11*d*.

The zone Z of greater flexibility is formed by a plurality of interwoven strips comprising a first relatively long strip 41 extending generally transversely of the back panel piece 37 from one side of the piece to the other, and a plurality of separate relatively short strips, each designated 43, extending generally at right angles to the transverse strip 41 at spaced intervals along the transverse strip. The transverse strip 41 is preferably formed by making two parallel slicing cuts in the back panel piece 37. The short strips 43 may have a color different from the color of the transverse strip 41 for purposes of appearance.

Figure 5:
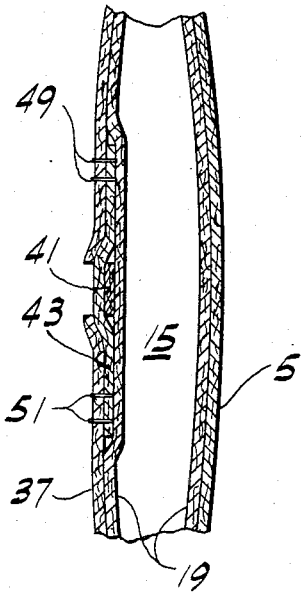
FIGS. 5 and 6 are enlarged vertical sections on lines 5—5 and 6—6, respectively, of FIG. 1.
Figure 6:
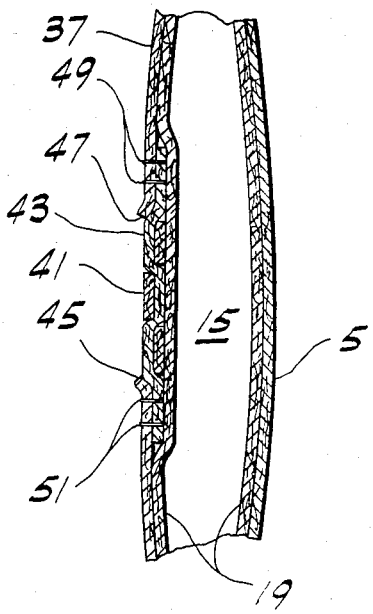
Figure 7:
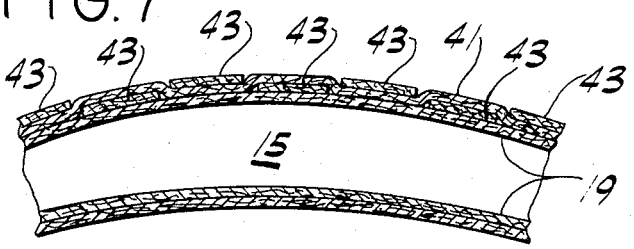
FIG. 7 is an enlarged horizontal section on line 7—7 of FIG. 1.

The short strips 43 are divided into two groups, those which extend over the long integral transverse strip 41, and those which extend under strip 41. It will be understood in this connection that the short strips 43 alternate in going either over or under the long transverse strip, that is, one strip 43 goes under the transverse strip 41 while the next adjacent strip 43 goes over the transverse strip. FIG. 5 illustrates a strip 43 of the first group extending over the transverse strip 41. As shown, the ends of the strip 43 lie flat against the inside face of the back panel piece 37 on opposite sides of the transverse strip 41. FIG. 6 illustrates a strip 43 of the second group extending under the transverse strip 41. As shown, this strip 43 extends up from a position in which its lower end lies flat against the inside face of the back panel piece 37 below the transverse strip 41, outwardly through a first transverse slit 45 in the back panel piece to a position on the outside of the back ply, under the transverse strip 41, back up on the outside of the back ply, and then inwardly through a second transverse slit 47 to a position in which the upper end of the strip lies flat against the inside face of the back panel piece 37. The ends of the strips 41, 43 of both groups are secured to the back panel piece 37 by a pair of double lines 49, 51 of stitching extending transversely with respect to the back of the glove. These double lines define the top and bottom boundaries of zone Z. It will be noted in this regard that the zone slopes slightly downwardly from right to left (as viewed in FIG. 1) at an angle corresponding aproximately to the knuckle line of the hand of a person wearing this glove.

The interwoven-strip construction described above provides a flexibility greater than that of a solid piece of material inasmuch as the strips are able to move relative to one another to dissipate any points of stress concentration when the glove is flexed (as when it is closed). Moreover, when the glove is flexed to close it, the interwoven strips 41, 43, and particularly the relatively short strips 43, tend to straighten out or extend, thereby providing a substantial amount of "give" which enables the glove to be closed more easily.

While the interwoven strips 41, 43 are illustrated as extending in side-to-side and top-to-bottom directions with respect to the glove, it will be understood that other orientations and configurations may be suitable. It will also be understood that the above-mentioned zone Z of greater flexibility may be created in some way other than through the use of interwoven strips (e.g., as by perforating the back of the glove or by slitting the back of the glove and bridging the slit with straps or thongs.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A baseball glove having an outer shell comprising front and a back plies joined together to form thumb and finger stalls and a hand-receiving pocket, said glove being a fielder's glove having four finger stalls separated by intervening crotches, a web between the thumb stall and adjacent (index) finger stall, a hand-receiving opening at the bottom of the glove providing entry into the shell, the back ply of the shell in the area between said stalls and the bottom of the glove being substantially closed for substantially covering the back of the hand of a person wearing the glove, a closed portion of the back ply in said area having a flexibility greater than the remainder of said area for enabling the glove readily to flex when the hand is flexed to close the glove.

2. A baseball glove as set forth in claim 1 wherein said closed back ply portion of greater flexibility is generally rectangular in shape and extends generally transversely with respect to the back ply of the glove.

3. A baseball glove as set forth in claim 2 wherein said closed back ply portion of greater flexibility is disposed approximately midway between the inner ends of said stalls and the bottom of the glove.

4. A baseball glove as set forth in claim 3 wherein said closed back ply portion of greater flexibility is formed by a plurality of interwoven strips.

5. A baseball glove as set forth in claim 1 wherein said closed back ply portion of greater flexibility is formed by a plurality of interwoven strips.

6. A baseball glove as set forth in claim 5 wherein said strips comprise a relatively long strip cut from said back ply and a plurality of relatively short strips interwoven with said long strip and secured to the back ply.

7. A baseball glove as set forth in claim 6 wherein the relatively short strips extend generally at right angles to the relatively long strip and are stitched to the back ply on the inside face of the ply.

8. A baseball glove as set forth in claim 2 wherein the back ply of the glove in said area has a single-finger opening therein located in alignment with the wearer's index finger when the wearer's hand is in said pocket, whereby the index finger of the wearer's hand may be inserted through the opening and placed on the outside of the back ply of the glove.

9. A baseball glove as set forth in claim 8 wherein said closed back ply portion of greater flexibility extends across the back ply of the glove from a point adjacent the little-finger side of the glove to a point adjacent said single-finger opening.

10. A baseball glove as set forth in claim 9 wherein said strip comprise a relatively long strip cut from said back ply and a plurality of relatively short strips interwoven with said long strip and secured to the back ply.

11. A baseball glove as set forth in claim 10 wherein the relatively short strips extend generally at right angles to the relatively long strip and are stitched to said back ply on the inside face of the ply.

12. A baseball glove as set forth in claim 1 wherein the back ply of the glove is formed by a plurality of separate pieces seamed together, said pieces comprising a thumb piece extending longitudinally of the thumb stall and forming a portion of the thumb stall, a first fourchette seamed to the thumb piece and extending longitudinally of the glove from the top to the bottom of the glove to form a part of the thumb stall, a part of the first (index) finger stall, and a part of the second finger stall, a second four-chette seamed to said first fourchette and extending longitudinally of the glove from the top of the glove to a point below the crotch between the second and third finger stalls to form part of the second finger stall and part of the third finger stall, a third fourchette seamed to the second fourchette and extending longitudinally of the glove from the top of the glove to a point below the crotch between the third and fourth fingers stall to form part of the third finger stall and part of the fourth finger stall, a little finger piece seamed to the third fourchette and extending longitudinally of the little finger stall to form a part of the little finger stall, and a back panel piece seamed at its top to the little finger piece and to the second and third fourchettes, and seamed along one side to the first fourchette, said closed back ply portion of greater flexibility extending across the back panel piece.

13. A baseball glove as set forth in claim 12 wherein said closed back ply portion of greater flexibility is generally rectangular in shape and extends generally transversely with respect to the back ply of the glove.

14. A baseball glove as set forth in claim 13 wherein said closed back ply portion of greater flexibility is disposed approximately midway between the lower ends of said stalls and the bottom of the glove.

15. A baseball glove as set forth in claim 14 wherein said closed back ply portion of greater flexibility is formed by a plurality of interwoven strips.

16. A baseball glove as set forth in claim 12 wherein said closed back ply portion of greater flexibility is formed by a plurality of interwoven strips.

17. A Baseball glove as set forth in claim 16 wherein said strips comprise a relatively long strip cut from said back panel piece and a plurality of relatively short strips interwoven with said long strip and secured to the back panel piece on the inside face thereof.

18. A baseball glove as set forth in claim 17 wherein the relatively short strips extend generally at right angles to the relatively long strip and are stitched to the back panel piece on the inside face thereof.

19. A baseball glove as set forth in claim 18 wherein said closed back ply portion of greater flexibility extends completely across said back panel piece from one side of the back panel piece to the other.

20. A baseball glove having an outer shell comprising front and a back plies joined together to form thumb and finger stalls and a hand-receiving pocket, a hand-receiving opening at the bottom of the glove providing entry into the shell, the back ply of the shell in the area between said stalls and the bottom of the glove being substantially closed for substantially covering the back of the hand of a person wearing the glove, a closed portion of the back ply in said area having a flexibility greater than the remainder of said area for enabling the glove readily to flex when the hand is flexed to close the glove, said closed back ply portion of greater flexibility being formed by a plurality of interwoven strips comprising a relatively long strip cut from said back ply and a plurality of relatively short strips interwoven with said long strip and secured to the back ply.

* * * * *

Disclaimer 4,527,287.—*Akio Aoki,* Osaka, Japan. BASEBALL GLOVE OR MITT. Patent dated July 9, 1985. Disclaimer filed Jan. 21, 1986, by the assignee, *Figgie International, Inc.*

Hereby enters this disclaimer to claims 1–5, 8–9, 12–16 and 19 of said patent.

[*Official Gazette March 11, 1986.*]